United States Patent [19]

Schermesser

[11] 4,017,763

[45] Apr. 12, 1977

[54] DEVICE FOR TRIGGERING THE DISCHARGE OF FLASH TUBES

[75] Inventor: Andre Schermesser, Kremlin Bicetre, France

[73] Assignee: Compagnie Generale d'Electricite, Paris Cedex, France

[22] Filed: Nov. 25, 1975

[21] Appl. No.: 635,014

[30] Foreign Application Priority Data

Nov. 29, 1974 France ..... 74.39197

[52] U.S. Cl. ..... 315/240; 315/241 R; 315/313; 315/341; 315/342; 331/94.5 P

[51] Int. Cl.[2] ..... H05B 41/32

[58] Field of Search ..... 315/326, 341, 342, 277, 315/231, 240, 241 R, 312, 313, 317, 320, 323, 325, 185 R, 187, 193; 320/1; 331/94.5 P

[56] References Cited

UNITED STATES PATENTS

| | | | |
|---|---|---|---|
| 3,430,159 | 2/1969 | Roeber | 331/94.5 P |
| 3,514,669 | 5/1970 | Helmuth | 315/241 R |
| 3,749,976 | 7/1973 | Colyn | 315/241 R |

*Primary Examiner*—Eugene R. LaRoche
*Attorney, Agent, or Firm*—Sughrue, Rothwell, Mion, Zinn & Macpeak

[57] ABSTRACT

Device for triggering the discharge of flash tubes, comprising a priming transformer whose primary winding is connected up in series with a priming capacitor and whose secondary winding is connected up in series with at least a flash tube, an ignitron connected up in series with the tube and a transformer for controlling that ignitron, the primary winding of that transformer being connected up in series with a control capacitor.

1 Claim, 1 Drawing Figure

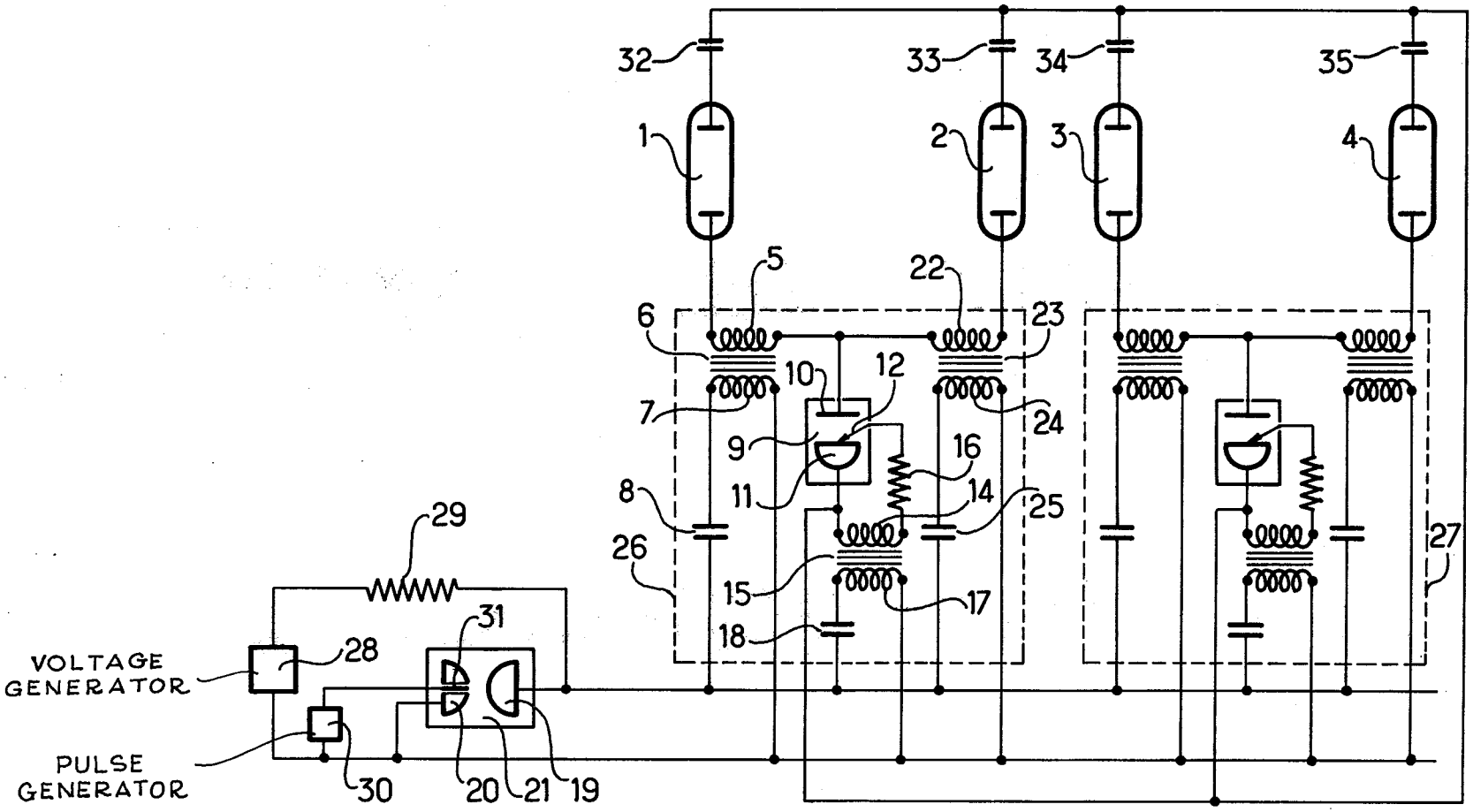
VOLTAGE GENERATOR
PULSE GENERATOR

DEVICE FOR TRIGGERING THE DISCHARGE OF FLASH TUBES

The present invention concerns devices for triggering the discharge of flash tubes and more particularly devices for triggering the discharge of flash tubes of laser generators.

It is known that certain high-power laser generators comprise an oscillator and several amplification stages, that oscillator and each of the amplification stages being provided with one or several flash tubes whose discharge must be triggered simultaneously.

In these types of laser generators, each of the flash tubes is generally triggered by means of an elementary device comprising more particularly on the one hand, a storage capacitor charged at a predetermined voltage and whose terminals are connected to the electrodes of the tube through an ignitron and on the other hand, a priming transformer whose secondary winding is connected up in series with the tube.

The elementary device comprises, moreover, a control transformer, whose secondary winding is connected up in series with the control electrode of the ignitron and whose primary winding is connected up in series with a control capacitor and a control thyratron.

The control capacitor being charged, the grid of the thyratron is polarized to cause the discharge of that capacitor in the primary winding of the control transformer. The result of this is an induced electric pulse in the secondary winding suitable for causing the firing of the ignitron, Lastly, the elementary device comprises a priming capacitor connected up in series with the primary winding of the priming transformer and with a priming thyratron. The priming capacitor being charged, the grid of that thyratron is biased to cause the discharge of that capacitor in the primary winding of the priming transformer. The result of this is a hightension electric pulse in the secondary winding suitable for priming the discharge of the flash tube when the ignitron is conductive.

For the ignitron to be conductive when the high-tension electric pulse is applied to the electrodes of the flash tube, the biasing voltage of the priming thyratron control grid is drawn off from a voltage divider constituted by a branch circuit formed by resistors in series, the ends of that branch circuit being connected respectively to one plane of the storage capacitor and to the other plate of that capacitor through the ignitron.

A device enabling the triggering of the discharge of the N flash tubes comprises N elementary devices such as that described hereinabove and a synchronizing device.

That triggering device has disadvantages. It is complicated and very bulky. Moreover, its operation is not very certain because of the lack of reliability of thyratrons.

The aim of the present invention is to overcome these disadvantages and to produce a device for triggering the discharge of flash tubes of simpler design which is less bulky and has great certainty of operation.

The object of the present invention is a device for triggering the discharge of flash tubes, that device comprising:

at least a switch comprising two main electrodes and an auxiliary electrode for controlling its conductivity;

a transformer for controlling that switch, one end of the primary winding of that transformer being connected to a plate of a control capacitor, the secondary winding of that transformer being connected up in series with the said auxiliary electrode, means for charging the said control capacitor, means for causing the discharge of that capacitor in the primary winding of that transformer so that the current induced in its secondary winding by that discharge be sufficient to cause the conductivity of the said switch;

at least one priming transformer, one end of the primary winding of that transformer being connected to a plate of a priming capacitor, one end of the secondary winding of that transformer being connected to an electrode of the said flash tubes, the said switch being connected up in series, by its main electrodes, to the secondary winding of that priming transformer;

a storage capacitor whose plates are connected respectively to the ends of the branch circuit in which are arranged in series the said flash tube, the secondary winding of the said priming transformer and the said switch;

means for electrically charging the said storage capacitor at a predetermined voltage;

means for charging the said priming capacitor and means for causing the discharge thereof in the primary winding of the said priming transformer so that the voltage induced in its secondary winding by that discharge be sufficient for priming the discharge of the said storage capacitor in the said tube, the said switch being conductive;

characterized in that the said means for electrically charging the said control and priming capacitors comprise, as do the means for causing their discharge:

a spark-gap provided with two electrodes, means for setting up, between those electrodes, a predetermined difference in electric potential, the other end of the primary winding of the said priming transformer and the other plate of the said priming transformer being connected respectively to the two electrodes of that discharger, the other end of the primary winding of the said control transformer and the other plate of the said control capacitor being connected respectively to the two electrodes of that spark-gap;

and means for causing an electric discharge between the electrodes of the said spark-gap subjected to the said predetermined difference in electric potential.

The present invention will be described hereinbelow with reference to the accompanying DRAWING, by way of illustration, but without any limiting character, in which the single FIGURE represents a diagram of an embodiment of the device according to the invention.

The device illustrated by the FIGURE is intended for triggering the discharge of four flash tubes 1, 2, 3, 4 of a laser generator comprising an oscillator and three amplifiers, the tube 1 being suitable for energizing, for example, the laser oscillator and the tubes 2, 3 and 4 being suitable for energizing the amplifiers of the light beam emitted by that oscillator. One end of the secondary winding 5 of a priming transformer 6 is connected to an electrode of the tube 1, one end of the primary winding 7 of the transformer 6 being connected to a plate of a priming capacitor 8. A switch 9 comprising two main electrodes 10 and 11 and an auxiliary electrode 12 for controlling the conductivity thereof, is connected up in series with the winding 5 and the tube 1, the other end of the winding 5 being, for example, connected to the electrode 10 of the switch 9. That switch can be, in some cases, a thyristor, but taking into account the high intensity of the current which it must generally control and the greatness of the voltages brought into play, the switch 9 is preferably constituted by an ignitron. The ends of the branch circuit containing in series the tube 1, the winding 5 and the switch 9, are connected to the plates of a storage capacitor 32. The circuit for controlling the conductivity of the switch 9 comprises, connected up in series between the electrodes 11 and 12, the secondary winding 14 of a control transformer 15 and a current-limiting resistor 16.

One end of the primary winding 17 of the transformer 15 is connected to a plate of a control capacitor 18.

The other plate of the capacitor 18 and the other end of the winding 17 are respectively connected to the two electrodes 19 and 20 of a spark-gap 21. The same applies to the other plate of the capacitor 8 and the other end of the winding 7.

If the performances of the switch allow it, it is possible to connect up in series with the switch several discharge tubes in parallel to one another. In the FIGURE, the discharge tube 2 is connected up in parallel on the winding 5 and the tube 1 through the secondary winding 22 of another priming transformer 23 whose primary winding 24 is connected, like the winding 7, to the electrodes of the spark-gap 21 through another priming capacitor 25. The ends of the branch circuit containing in series the tube 2, the winding 22 and the switch 9 are connected to the plates of another storage capacitor 33.

Lastly, the device can comprise several systems such as the system 26 connecting the tubes 1 and 2 to the spark-gap 21 and to the capacitors 32 and 33, that system 26 being composed of the switch 9, the transformers 6, 23 and 15 and the capacitors 8 and 25. Thus, the figure shows a system 27 which is absolutely analogous to the system 26 and connects the discharge tubes 3 and 4 to the spark gap 21 and to two other storage capacitors 34 and 35.

The device shown in the FIGURE operates as follows:

The storage capacitors 32, 33, 34 and 35 are charged at a predetermined voltage by feed systems of a known type, not shown. The control capacitors such as 18 and the priming capacitors such as 8 and 25 are charged likewise. That charge is effected for example by means of a voltage generator 28 through a resistor 29 one of whose terminals is connected to an electrode of the spark-gap 21 so as to set up between the electrodes 19 and 20 of the spark-gap 21, a predetermined difference in electric potential whose value is slightly less than the priming voltage of the spark-gap 21.

To trigger the discharge of the flash tubes 1, 2, 3 and 4, an electric discharge is caused between the electrodes of the spark-gap 21 for example by means of a pulse generator 30 whose terminals are connected respectively to the electrode 20 having an annular shape and to a counter-electrode 31 arranged axially inside the electrode 20. The pulses emitted by the generator 30 set up between the electrode 20 and the counter-electrode 31 a pre-ionization suitable for triggering an electric discharge between the terminals of the spark-gap 21.

That electric discharge causes the discharge of each control capacitor in the primary winding of the corresponding control transformer. Thus, the capacitor 18 is discharged in the winding 17 generating an electromotive induction force in the secondary winding 14 of the transformer 15, that electromotive force being sufficient for causing the conductivity of the switch 9. Simultaneously, the priming capacitors such as 8 and 25 discharge respectively in the windings 7 and 24 so as to set up in the windings 5 and 22 a voltage pulse suitable for priming the discharge of the storage capacitors 32 and 33 respectively in the flash tubes 1 and 2. Of course, the capacities of the control and priming capacitors as well as the inductances of the windings of the control and priming transformers will be chosen so that the response time of the control circuits be less that that of the priming circuits and that the switches be conductive before the priming voltage is applied to the terminals of the discharge tubes.

The device described hereinabove and illustrated by the FIGURE has the advantage of being very certain in operation and of enabling numerous discharges of flash tubes to be effected without replacing the various elements. It is known, indeed, how to manufacture very reliable spark-gaps, whereas thyratrons used in the device according to prior art have a relatively short-service life.

The reliability of the device according to the invention is further increased by the fact that the priming voltage of the tubes sent out by the priming transformers is independent from the charge voltage of the storage capacitors, this not being the case in the device according to prior art.

That independence of the priming voltage with respect to the charge voltage for the storage capacitors is important, for it is necessary in practice to make the charge voltage of the storage capacitors vary to take into account on the one hand the energy required for the discharge of the tubes and on the other hand the ageing of the tube. If the device according to prior art is used, these variations can cause defects in the priming of the flash tubes.

The device described hereinabove has, moreover, the advantage of being very simple and having slight bulk. The reduction in bulk is obtained more particularly subsequent on the one hand to dispensing with the thyratrons and with the synchronizing device and on the other hand to a great reduction of the capacity of the priming capacitors, that reduction being effected, subsequent to the very low impedance of the spark-gap with respect to the thyratrons. The reduction in the bulk is particularly important when it is intended to control simultaneously the dicharge of a great number of flash tubes. It is possible to trigger with a single discharger up to 40 flash tubes each having a current of 700 Amperes flowing through it.

The device according to the present invention can be applied more particularly to the triggering of the flash tubes of a high-power laser generator, comprising an oscillator and several amplifiers.

I claim:

1. Device for triggering the discharge of flash tubes and comprising:

at least a switch comprising two main electrodes and an auxiliary electrode for controlling its electrical conduction;

a control transformer for controlling the switch, one end of the primary winding of the control transformer being connected to a plate of a control capacitor, the ends of the secondary winding of the control transformer being connected respectively to one main electrode and to said auxiliary electrode, means for charging said control capacitor and for discharging it in the primary winding of the control transformer so that the current induced in its secondary winding by the discharge is sufficient to make said switch conductive;

at least one starting transformer, one end of the primary winding of the starting transformer being connected to a plate of a starting capacitor, one end of the secondary winding of the starting transformer being connected to an electrode of one of said flash tubes, said switch being connected by its main electrodes in series with the secondary winding of the starting transformer;

a storage capacitor whose plates are connected respectively to the ends of the branch circuit in which are arranged in series said flash tube, the secondary winding of said starting transformer and said switch;

means for electrically charging said storage capacitor at a first predetermined voltage;

means for charging said starting capacitor and for discharging it into the primary winding of said starting transformer so that the voltage induced in its secondary winding by the discharge is sufficient for starting the discharge of said storage capacitor into said tube, said switch being conductive; and wherein the means for electrically charging and discharging respectively said control and starting capacitors comprise:

a spark gap provided with two electrodes, means for setting up a second predetermined voltage between the two electrodes, the other end of the primary winding of said starting transformer and the other plate of said starting capacitor being connected respectively to the two electrodes of the spark-gap, the other end of the primary winding of said control transformer and the other plate of said control capacitor being connected respectively to the two electrodes of the spark-gap; and means for causing an electric discharge between the two electrodes of said spark-gap, the electrodes being charged to said second predetermined voltage.

* * * * *